US006151774A

United States Patent [19]

Nold, III

[11] Patent Number: 6,151,774

[45] **Date of Patent: *Nov. 28, 2000**

[54] SYSTEM OF CONVEYING AND ASSEMBLING LOGGING TOOLS

[75] Inventor: Raymond V. Nold, III, Round Rock, Tex.

[73] Assignee: Schlumberger Oilfield Services, Inc., Austin, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/843,794

[22] Filed: Apr. 21, 1997

Related U.S. Application Data

[63] Continuation of application No. 08/349,235, Dec. 5, 1994, abandoned.

[51] Int. Cl.[7] ..... E21B 19/00; B23P 19/00

[52] U.S. Cl. ..... 29/822; 414/22.54; 212/337; 254/266

[58] Field of Search ..... 254/362, 323, 254/266; 29/822, 823, 824; 414/22.51, 22.54, 539, 745.4, 745.5, 745.6; 212/77, 83, 337, 338, 339, 342; 104/112; 81/176.1, 54

[56] References Cited

U.S. PATENT DOCUMENTS

| | | | |
|---|---|---|---|
| 2,371,887 | 3/1945 | Hamilton, Jr. | 212/77 X |
| 2,706,416 | 4/1955 | Stewart | 254/266 |
| 3,858,728 | 1/1975 | Fathauer | 212/42 |
| 3,865,256 | 2/1975 | Freeman, Sr. | 414/22.54 |
| 4,054,210 | 10/1977 | Crocker | 212/77 X |
| 4,098,532 | 7/1978 | Phillips | 414/22.54 X |
| 4,492,502 | 1/1985 | Delano | 414/22.54 |
| 4,754,886 | 7/1988 | Hirano | 212/77 X |
| 4,765,435 | 8/1988 | Reichert | 254/323 |
| 5,292,108 | 3/1994 | Sutton | 254/323 |
| 5,316,265 | 5/1994 | Welch et al. | 254/362 |

FOREIGN PATENT DOCUMENTS

| | | | |
|---|---|---|---|
| 3327809 | 2/1985 | Germany | 254/273 |

*Primary Examiner*—David P. Bryant
*Attorney, Agent, or Firm*—Martin L. McGregor

[57] ABSTRACT

A system and method for conveying wireline tools between a wellsite and a logging truck and for assembling the tools at the wellsite is disclosed. The conveying system includes a taut line extending between a wellsite and the logging truck, a mechanism for anchoring the taut line at the wellsite, and a mechanism for tensioning the taut line. A trolley on the taut line is attachable to a logging tool and operable to convey the tool between the truck and the wellsite. Preferably, the logging tools are stored in a tool bed adjacent the rear axle of the logging truck so that they can be easily displaced and connected to the trolley for conveyance along the taut line to the wellsite. At the wellsite, the operators use a remote winch control for controlling the rotation of the logging cable winch and the position of any tools at the wellsite connected to the logging cable. A spanner is provided which permits the operator to connect two tools together (or disassemble) using one hand. As can be appreciated, the system and method of the present invention permits two people to efficiently convey, assemble, and log an oil well.

29 Claims, 6 Drawing Sheets

SYSTEM OF CONVEYING AND ASSEMBLING LOGGING TOOLS

This is a Continuation of application Ser. No. 08/349,235, filed on Dec. 5, 1994, now abandoned.

BACKGROUND OF THE INVENTION

The present invention relates generally to a method and system for improving the efficiency of an oil well wireline logging operation, and more particularly to a method and system for conveying wireline tools between a wellsite and a logging truck and assembling the tools at the wellsite.

DESCRIPTION OF THE RELATED ART

Efficiency in the wireline logging of an oil well is important. Often, a wellsite temporarily shuts down its drilling or other operations for the wireline service company to perform its logging services. Of course, it is expensive to shut down drilling operation and anytime a logging service company is at a wellsite, there is a lost time cost to the driller or oil company.

A logging service company typically brings a data acquisition unit to the wellsite. For wellsites on land, the data acquisition unit is typically a logging truck which drives to the wellsite and positions itself a short distance from the catwalk surrounding the wellsite. Logging tools are hand carried to the catwalk. As is well known in the art, the logging cable is attached by one end to a main winch and spooled onto the winch. A control console operator operates a control console inside the logging truck which controls the winch and spools and unspools or takes off and takes up the logging cable. The winch in the logging truck may typically be 50 to 100 feet away from the drill rig and the well itself. A second operator configures the logging setup at a wellsite. First, he deploys the logging cable from the logging truck to the drill floor. Although this procedure may vary somewhat with the wellsite, it generally involves manually extending the logging cable as it is being unrolled by the control console operator, laying slack from the logging cable out on the ground, commonly in large figure eights, and walking a loose end of the cable to the drill rig, which is positioned over the well. The logging cable must extend the full distance between the logging truck and the drill rig, which may typically be a horizontal distance of 50 to 100 feet. During this operation, the second operator communicates with the console operator, by signalling how much logging cable should be taken off or taken up, while properly deploying the logging cable. This communication can be problematic, particularly if the operation takes place at night or under severe weather conditions. Imperfect communications between the two operators can also compromise safety. The logging cable extends from the truck to the ground, where the slack is laid out, and then, at an angle less than 90 degrees, up to the drill rig. There, the loose end of the cable is threaded through a first pulley attached to the rig floor. The first pulley changes the direction of the logging cable to upwardly vertical. The loose end of the logging cable is then threaded through a second pulley attached to an elevatable portion of the drill rig, which is in a lowered position. The second pulley changes the direction of the logging cable so that it is downwardly vertical. The elevatable portion of the drill rig is elevated, taking the slack out of the logging cable. This results in the loose end of the logging cable being positioned above the well, ready to be connected to one or more logging tools which will be lowered inside the well. One logging tool will be coupled to the loose end of the logging cable, a second tool may be coupled to the first tool and so on. The second operator makes these couplings on the drill floor, while signaling to the console operator to raise or lower the logging cable and tools by spooling or unspooling more logging cable. As in deployment of the logging cable, imperfect communications between the two operators can compromise safety. After all of the appropriate tools are coupled, the well is then logged. Wells vary considerably in depth, but typically logging depths may range anywhere from 1200 feet to over 20,000 feet. The tools are then assembled and connected to the logging cable and lowered into the well for logging.

A typical logging crew is comprised of a field engineer and two operators. A primary reason for having two operators at a wellsite is because of the necessity to carry the logging tools to and from the wellsite, the labor involved in configuring the tools into a tool string, connecting them to the logging cable, and raising and lowering the logging tools into the oil well. It is, of course, desirable to operate the well logging operation with fewer people. However, it is important that the time the logging crew spends in providing its services is minimized to reduce the lost time cost. Therefore, it would be a useful advance if systems and methods were devised for conveying wireline tools between a wellsite and truck and for efficiently configuring the tools for logging operations.

SUMMARY OF THE INVENTION

Broadly speaking, the present invention provides systems and methods for increasing the efficiency of the logging service company at a wellsite, while reducing the need for three persons to perform the logging operation. That is, the methods and systems hereof allow a two man crew to convey wireline tools between the logging unit and the wellsite, configure and deconfigure the logging tools for operation, and to perform the logging services accurately in a minimum amount of time.

The method of conveying wireline tools between a wellsite and a logging truck of the present invention includes the steps of extending a taut line between the truck and the wellsite, anchoring the taut line to the wellsite, and tensioning the taut line between the truck and the wellsite. With the taut line tensioned, the method displaces a wireline tool from the truck and couples the tool to the taut line. The tool is then moved along the taut line from the truck to the wellsite and decoupled from the taut line at the wellsite. Preferably, the taut line is a static line and the tools are connected to a trolley and slid along the taut line between the truck and the wellsite.

The system for conveying wireline tools between a wellsite and a wireline logging truck includes a tool bed in the logging truck configured for holding one or more logging tools. Preferably the tool bed is disposed along a lower portion of the truck proximate the rear axles facing the rear of the truck in the same direction as the logging cable. A taut line is extended from the truck to the wellsite, anchored, and tension applied sufficient to support the weight of a tool on the taut line. A trolley mechanism attaches to a logging tool for conveying the tool between the truck and the wellsite. Preferably the tension mechanism is a traverse winch which can be positioned over the tool of interest so that the taut line and tool are in general alignment. The tool trolley slidably engages the taut line and includes an engagement sleeve configured to couple to the logging tool and an elevation mechanism for selectively raising and lowering the logging tool.

The preferred tool trolley slidably engages a line or other support structure extended between the truck and the wellsite. The trolley includes an engagement sleeve configured to couple to a logging tool and an elevation mechanism for selectively raising and lowering the logging tool when it is coupled to the sleeve. The sleeve is preferably a chain configured to be wrapped around the logging tool and at least one end of the chain may be connected and disconnected from the trolley. An elongated pivotal toggle provides a mounting point for one end of the chain so that the pivotal movement of the toggle moves the chain, thereby raising or lowering the connected logging tool.

Wellsite efficiency is increased by including as part of the system a spanner for helping connect logging tools and a remote winch control for operating the main winch holding the logging cable. Preferably, the logging tools have threaded couplings at each end and one of the threaded couplings has an engagement ring and is rotational at the end of the tool. The spanner is configured for connection to the engagement ring so that operation of the spanner rotates the engagement ring and the associated threaded coupling. This spanner drive mechanism allows easy connection of two logging tools when the threads are placed in contact with each other. The remote winch control allows one of the logging crew to take up and take off logging cable from the winch, while simultaneously extending the logging cable from the truck, to the ground where slack is laid, and through the first and second pulleys at the drill rig, all in preparation for logging. Thus the need for a console operator during this operation is eliminated, because a single operator can deploy the logging cable in preparation for logging and can simultaneously control the taking off and taking up of the logging cable needed for that deployment. Similarly, a single operator can retrieve the logging cable after the logging operation is completed and control its take up on the winch. This reduces the required manpower and eliminates the problem of imperfect communication between the operators. This is particularly important during make-up and breakdown of the logging tool system. Using the method and system of the present invention it is possible for a single person to convey tools between the wellsite and the truck and to perform most of the operations for configuring and decommissioning the logging setup.

BRIEF DESCRIPTION OF THE DRAWINGS

FIG. 2A is a side elevation view of the trolley with a supported wireline tool in a raised position, FIG. 2B is a front elevation view of the trolley with the tool in the raised position, FIG. 2C is a side elevation view, similar to FIG. 2A, with the tool in the lowered position, and FIG. 2D is a front elevation view, similar to FIG. 2B, with the trolley and tool in the lowered position;

FIG. 5A is an elevational view of two tools and a spanner, FIG. 5B is an enlarged, side elevational view of the connection of the spanner to the threaded coupling of one tool, and FIG. 5C is an enlarged front elevation view of the spanner connection to the engagement ring of the threaded coupling.

DESCRIPTION OF THE PREFERRED EMBODIMENT

Figure 1:
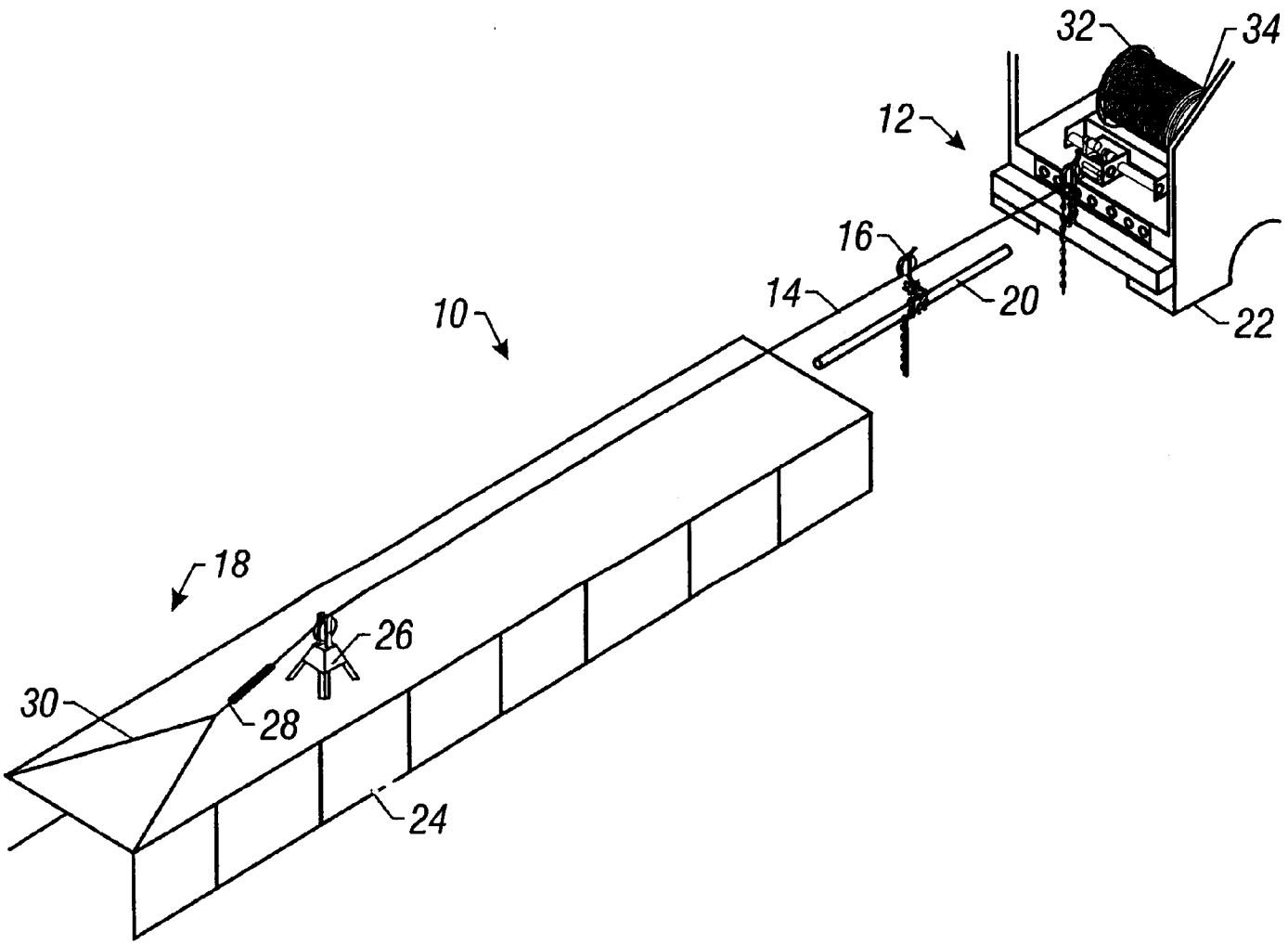
FIG. 1 is a perspective schematic showing the system for conveying wireline tools between a logging truck and a wellsite.

Turning now to the drawings, FIG. 1 illustrates the conveying system 10 of the preferred embodiment of the present invention. Broadly speaking, the conveying system 10 includes the traverse winch 12, taut line 14, trolley 16 and anchor system 18. As can be seen in FIG. 1, the trolley 16 supports tool 20 under the taut line 14. The taut line 14 extends from the truck 22 to a catwalk 24 surrounding the wellsite. It should be appreciated that the catwalk 24 in FIG. 1 is symbolic of a general target area or tool assembly area for placement of the tools 20 and would vary depending on location. Generally, a tool assembly area such as catwalk 24 is adjacent or surrounding the wellbore. Additionally, the distance of the truck 22 from the catwalk or target area 24 will vary depending upon location, but generally the target area is within about 20 degrees and 100 feet (or 50 meters) of the rear of the vehicle.

In more detail, the anchor system 18 includes an adjustable stand-off 26 positionable on the catwalk 24 to engage the taut line 14. The stand-off 26 includes a guide wheel slidably engaging the taut line 14, which helps compensate for tools or loads placed on the taut line 14. The end of the taut line 14 terminates in turnbuckle 28 which is secured by two or more anchor chains 30 to the catwalk 24.

As can be seen in FIG. 1, the logging truck includes a cable winch 32 holding logging cable 34. Positioned at the rear of the truck, along the area of the rear axles, is tool bed 36 for holding a plurality of tools 20. Turning to FIG. 3, the rear of the truck 22 is shown in more detail. The traverse winch 12 is mounted for sliding, traversing movement along a spindle 40 perpendicular to the taut line 14. As can be seen, the spindle 40 is mounted at the rear of the truck at the base of the cable winch 32 such that the traverse winch 12 can be positioned vertically over the tool bed 36. Traverse winch 12 includes a drum 42 for holding a length of the taut line 14. A winch drive 44 powers the drum 42 for taut line 14 reel in. Preferably, the winch drive 44 is operable at a high speed or a low speed and has a setting for "free spooling" so taut line 14 can be manually unwound from the drum 42. Although the disposition of the trolley 16 relative to the other components of the conveying system 10 is illustrated in FIG. 3, the details of the structure and operation of the trolley 16 is best illustrated in FIGS. 2A–2D.

Figure 2D:
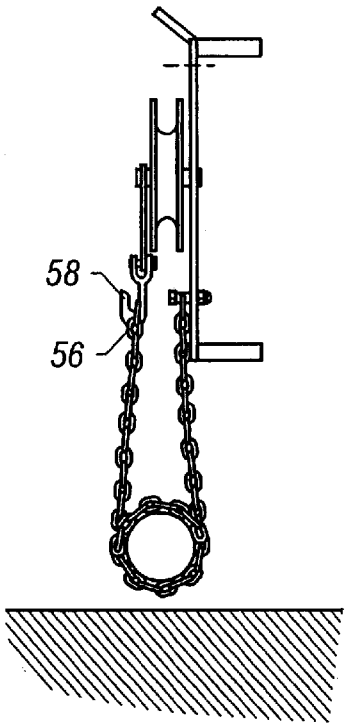
FIGS. 2A–2D illustrate the tool trolley of the present invention where
Figure 2C:
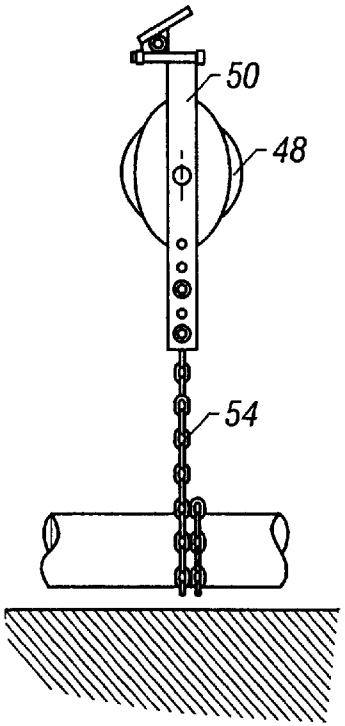
Figure 2B:
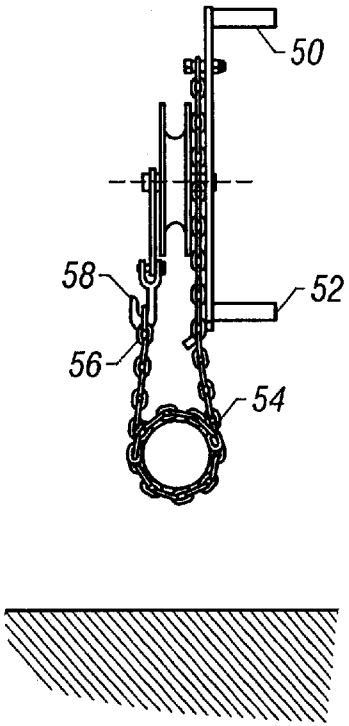
Figure 2A:
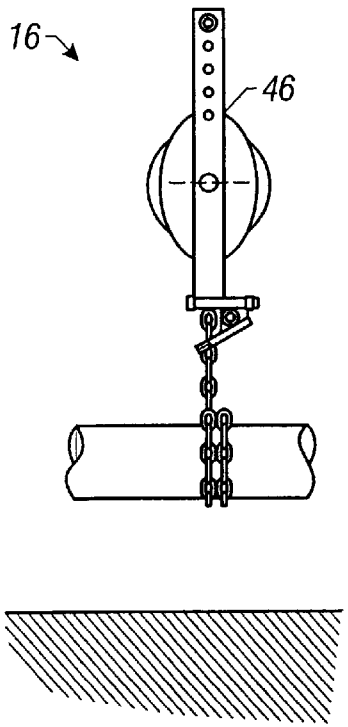
Figure 3:
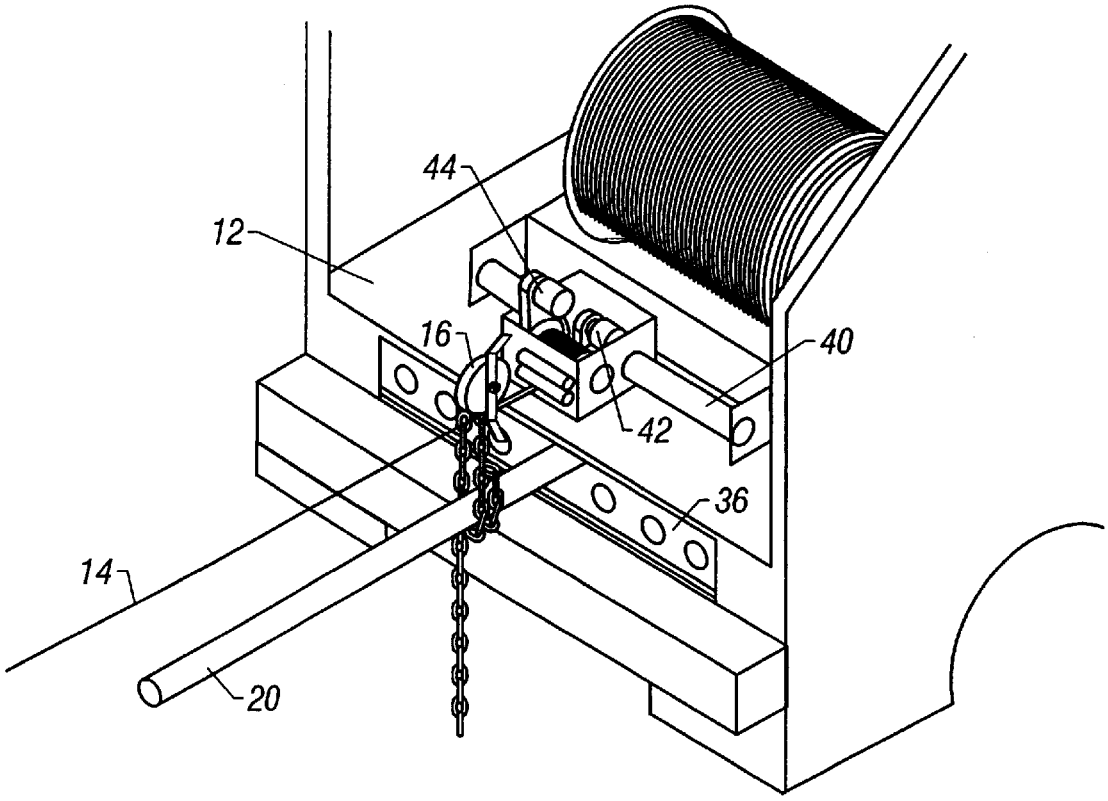
FIG. 3 is a perspective view of the rear of a logging truck, depicting the tool bed, taut line, trolley, and traverse winch in the system of the present invention.

FIGS. 2A and 2B illustrate the trolley 16 with a tool 20 in the raised position while FIGS. 2C and 2D illustrate the trolley 16 with a tool in the lowered position. Trolley 16 generally includes a body 46 comprising pulley 48 for rotationally engaging the taut line 14. An elongated pivot arm 50 is attached to the body 46 at the center rotational point of the pulley 48 and has a pair of handles 52 for pivotal operation. A chain 54 operates as an engagement sleeve to engage the tool 20 as shown in FIGS. 2A–2D. One end of the chain 54 is affixed to the elongated arm 50 while the free end 56 of the chain 54 is wrapped around the tool 20 and secured to the hook 58. As can be appreciated from the lowered position illustrated in FIGS. 2C and 2D, pivotal movement of the elongated arm 50 to the 180 degree position in FIGS. 2A and 2B raises the tool 20 an amount equal to the moment arm of arm 50.

Figure 4:
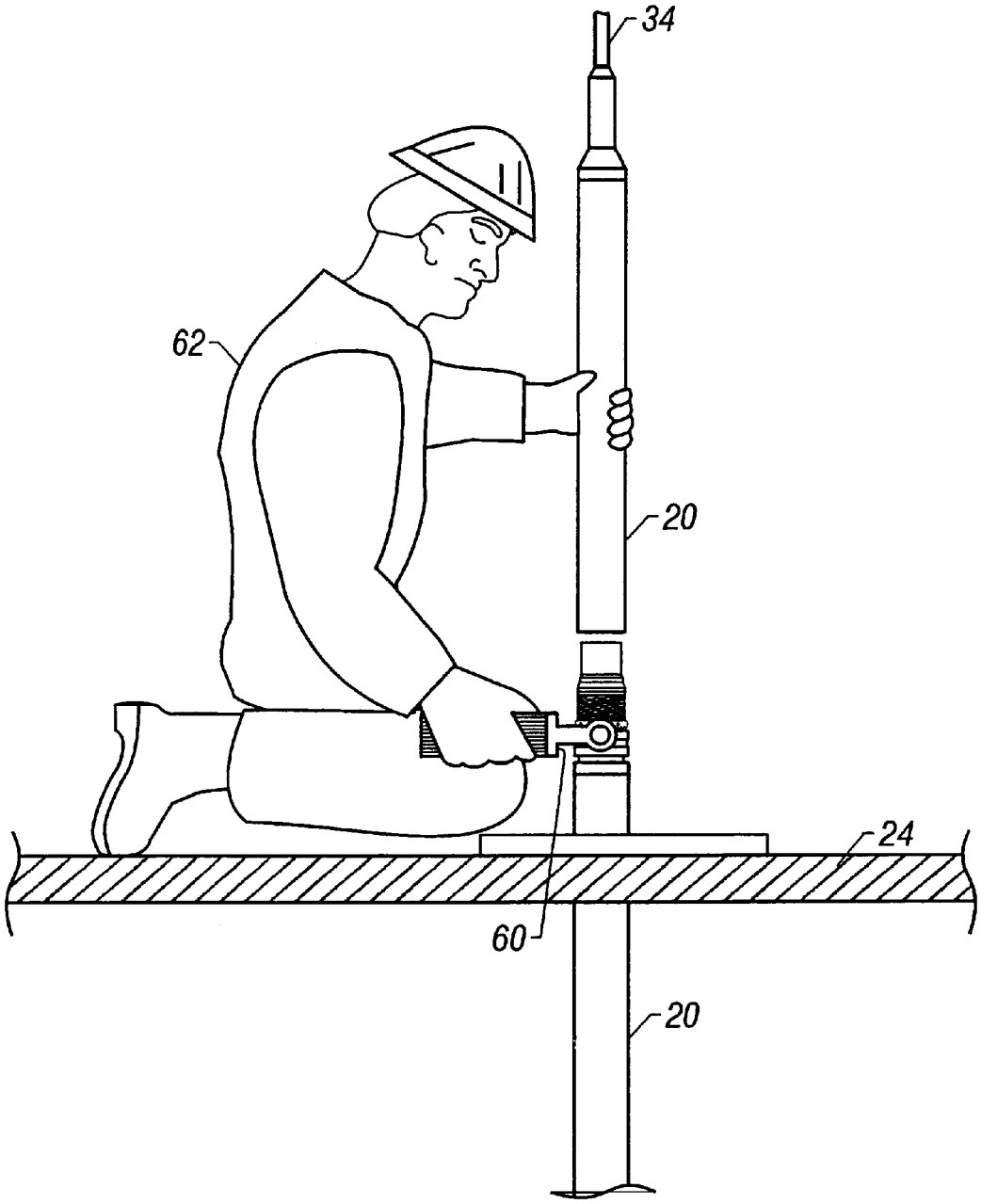
FIG. 4 is a side elevation view of an operator using a spanner in accordance with the present invention to assemble and disassemble the logging tools.
Figures 5A, 5B, 5C:
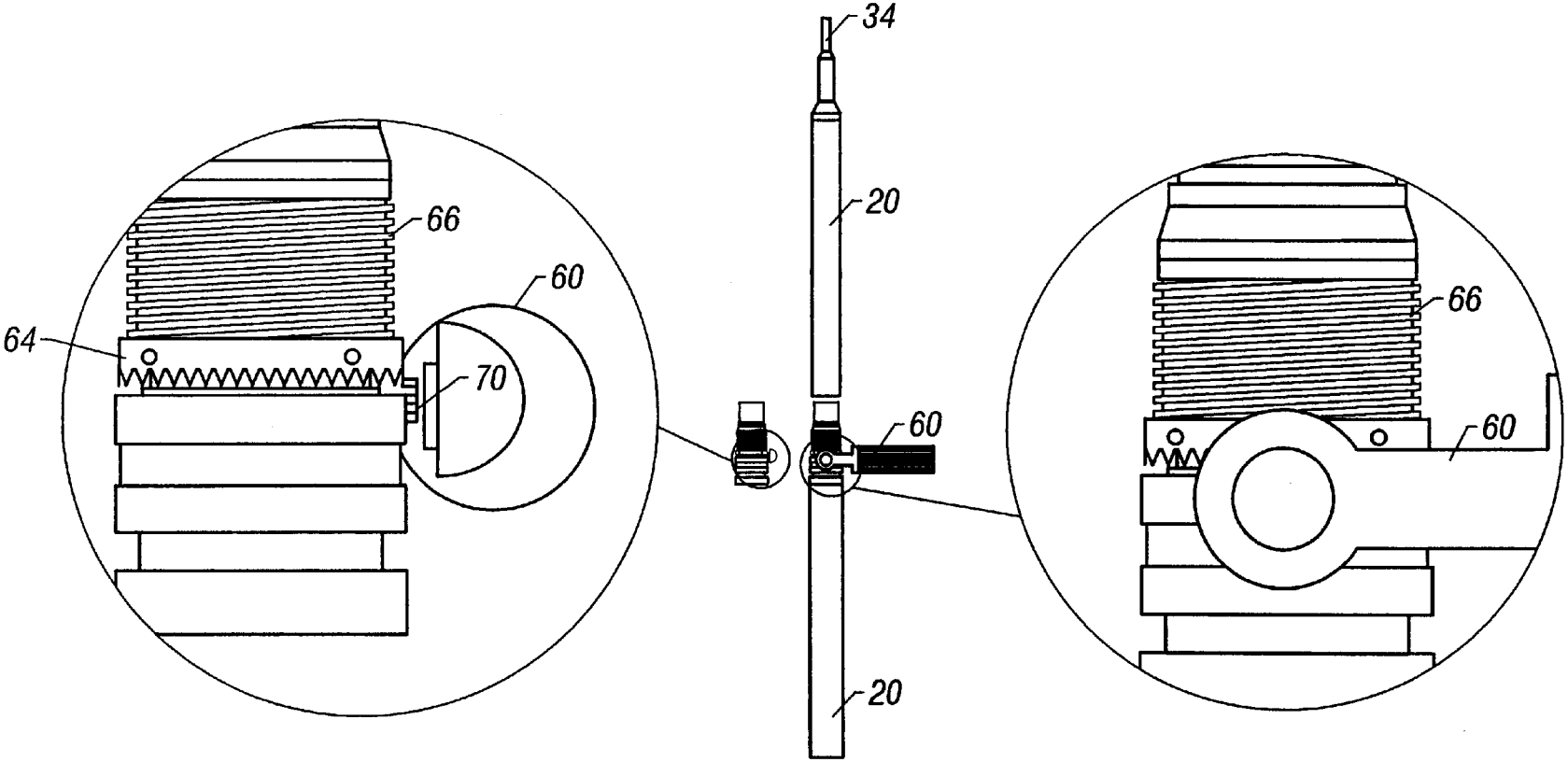
FIGS. 5A–5C illustrate the use of a spanner in assembling two wireline logging tools where

Turning to FIGS. 4 and 5, the use of the spanner 60 by operator 62 is illustrated. FIG. 5 shows the details of the tool connection system in enhanced form. As can be seen in FIG. 5, an upper tool 20 is connected to the logging cable 34 and the operator 62 desires to connect a lower tool 20 to the upper tool. The upper tool 20 has a threaded female coupling (not shown) while the lower tool 20 has a threaded male coupling 66. The threaded male coupling 66 is configured to rotate about the distal end of the tool 20, the lower tool in FIGS. 4–5. An engagement ring 64 is secured to the threaded coupling 66 at the base thereof to rotate together as a single piece. The engagement ring 64 includes a plurality of spaced teeth 68 which are complimentarily shaped to fit and engage with gear 70 of the spanner 60.

Figure 6:
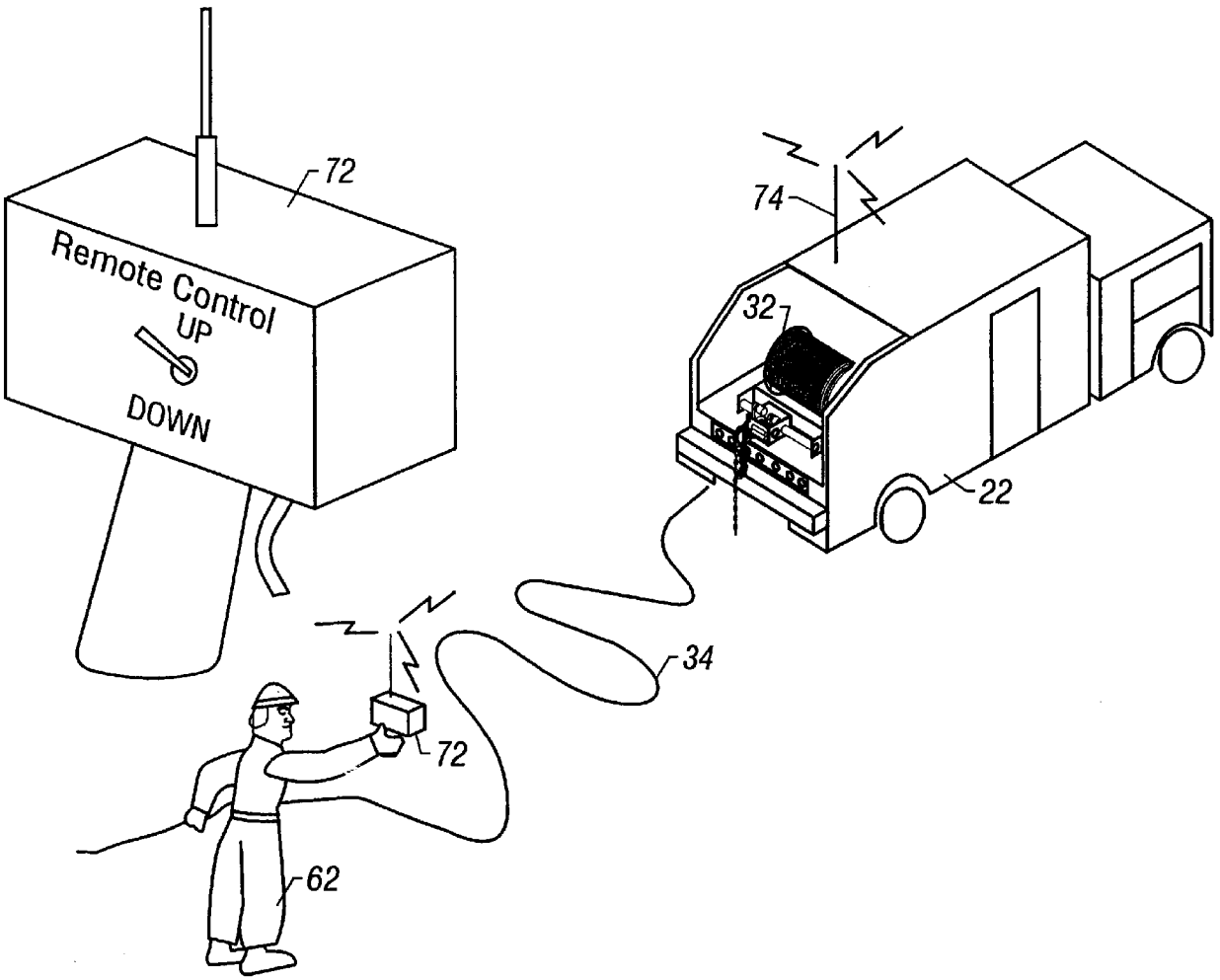
FIG. 6 is a perspective view of a logging crew using a remote winch control of the present invention.

Turning now to FIG. 6, the configuration and use of a remote winch control 72 is illustrated. The truck 22 includes a receiver 74 which operates to control the rotational movement of the cable winch 32. The operator 62 holds the winch control unit 72 which includes a transmitter. The winch control 72 includes a two position toggle labeled "up" and "down" which operates to control the reel in and reel out of cable winch 32. That is, cable 34 is reeled in or reeled out of cable winch 32 upon selection by the operator of "up" or "down" on the winch control 72. The receiver 74 may be a radio receiver responding to radio control signals sent from the transmitter.

OPERATION

Turning to FIGS. 1 and 3, the conveying system 10 is generally set up at a wellsite by backing the truck towards the wellsite having a catwalk 24 or other suitable target area. The drum 42 on the traverse winch 12 is disengaged and the taut line 14 free spooled off the drum 42 and extended to the catwalk 24. The taut line 14 is threaded through stand-off 26, connected to turnbuckle 28, and anchor chains 30 secured to the catwalk 24. The adjustable stand-off 26 is then positioned under the taut line 14 (see FIG. 1). The drive 44 of the traverse winch 12 is then operated to apply tension to the taut line 14. Alternatively or in addition to, the turnbuckle 28 can make minor adjustments in the tension of the taut line 14. It should be appreciated that generally the drive 44 is operated to release tension on the taut line 14 before the traverse winch 12 is repositioned on the spindle 40 over a tool of interest 20 in the tool bed 36. After the traverse winch 12 is properly positioned over a tool of interest, the winch drive 44 is again operated to apply tension to taut line 14 before the weight of the tool is applied to the taut line 14.

With the taut line 14 anchored and tension applied, the trolley 16 is mounted on the taut line 14 as shown in FIG. 3. Referring to FIGS. 2 and 3, the operator connects the trolley 16 to the tool 20 by wrapping the free end 56 of the chain around the tool 20 and fastening it to the hook 58. Pressure is then applied to the arm 50 to raise the tool 20 from the tool bed 36 as the tool 20 and trolley 16 are slid away from the truck 22. As shown in FIG. 1, with the tool 20 in the raised position it is wheeled along the taut line 14 onto the catwalk 24. Most tools can be conveyed by a single operator and single trolley 16 positioned near the tool's center of gravity. However, an additional trolley 16 (FIG. 1) can be used if necessary for long, or heavy tools, inclined line 14, etc.

When the tool 20 reaches the appropriate target area, the tool 20 is lowered by pivotal movement of the arm 50 to the lowered position as shown in FIGS. 2C and 2D. With the desired tools 20 positioned on the catwalk 24, the operator 62 then assembles a string of tools.

As shown in FIG. 4, the logging cable 34 extends down from overhead the drill rig and can be positioned up and down using the remote winch control 72 (FIG. 6). To connect the lower and upper tools in FIG. 4, the operator positions the tools 20 so that the threaded couplings are proximate each other and then with one hand controls the spanner 60 to force the threading engagement of the upper and lower tools 20. As can be seen in FIG. 4, with one hand operating the spanner 60 the other hand is free to engage one of the tools 20 to insure alignment of the tools and threaded coupling thereof. The gear 70 of the spanner is inserted in the threaded coupling 66 to engage the teeth 68 of engagement ring 64. The operator then applies power to spanner 60, rotating the engagement ring 68 and coupling 66. With a two man crew, it can be appreciated that the remote control 72 allows both persons to be on the wellsite for assembling the tools and control the up and down movement of the logging cable 34 without the necessity of walking back to the truck 22.

I claim:

1. A system for conveying and assembling wireline logging tools at a wellsite comprising:

a taut line extending between a tool storage location and a tool assembly location near a wellbore at the wellsite;

a tool trolley engaging the taut line for movement between said storage and assembly locations and having a tool engagement sleeve for selectably connecting a tool to the trolley;

a logging cable having one end positionable at the tool assembly location for travel into the wellbore at the wellsite and the other end wrapped and stored on a logging cable winch;

a winch remote control for selective rotation of the logging cable winch for controlling the movement of said logging cable;

a plurality of logging tools including threaded couplings at the respective distal ends and one of said threaded couplings including an engagement ring; and a spanner configured to threadingly connect two logging tools, said spanner including a gear configured for engaging and rotating said engagement ring.

2. The system of claim 1, the trolley including an elevation mechanism for selectively raising and lowering a logging tool.

3. The system of claim 1, including a tension means coupled to the taut line for applying tension to the taut line.

4. The system of claim 1 further comprising:

a tool storage location which comprises a toolbed in a logging truck configured for holding one or more logging tools;

anchor means for securing the taut line to the well site; and tension means for applying tension to the taut line.

5. The system of claim 4, wherein the tool bed is disposed near the rear axles of the logging truck for holding a plurality of generally parallel tools in the truck.

6. The system of claim 4, wherein the taut line comprises a steel braided cable which may be extended between the truck and the wellsite.

7. The system of claim 4, further comprising a drilling rig located at the wellsite and the anchor means comprising a standoff for engaging the taut line near the wellsite and one or more anchor fasteners for securing the taut line to the drilling rig at the well site.

8. The system of claim 4, said tension means comprising a traverse winch mounted in the truck having a drum for rotationally holding the taut line and being operable for applying tension to the taut line while one end of the taut line is anchored at the wellsite.

9. The system of claim 4 said tool trolley having an engagement sleeve configured to couple to any of the plurality of logging tools and an elevation means for selectively raising and lowering a selected logging tool.

10. The system of claim 1, said tool trolley further comprising:

a body configured to slidably engage the taut line extending between the tool storage location and the wellsite;

the tool engagement sleeve being attached to the body and configured to couple a logging tool to the body; and elevation means attached to the body or sleeve for selectively raising and lowering a logging tool coupled to said sleeve.

11. The system of claim 10, wherein said body includes a pulley for rotationally engaging the taut line.

12. The system of claim 10, said sleeve comprising a link chain configured to be wrapped around the selected logging tool, both ends of the chain being connectable to said body.

13. The system of claim 10, said elevation means comprising an elongated pivotal toggle with one end coupled to said sleeve, where upon pivotal movement of said toggle said sleeve and logging tool are raised or lowered.

14. The system of claim 1 further comprising an apparatus for connecting the distal ends of two logging tools comprising:

a first threaded coupling at the distal end of one logging tool;

a second threaded coupling at the distal end of another logging tool being rotationally disposed on said tool and having an engagement ring; and a spanner configured for operative coupling to said engagement ring for rotating said second threaded coupling and connecting said threaded first and second couplings when said tools are placed end to end in operative proximity.

15. The system of claim 14, said second coupling being a male nipple with said engagement ring at the base of the coupling.

16. The system of claim 14, said engagement ring being annular and having a plurality of teeth disposed thereon.

17. The system of claim 16, said spanner including a rotational gear configured for complimentary engagement with the teeth of the engagement ring.

18. The system of claim 14, said spanner being electrically powered for rotating the engagement ring at high speeds.

19. A system for conveying wireline logging tools at a wellsite comprising:

a taut line extending between a tool storage location and a tool assembly location near a wellbore at the wellsite;

a transportation device engaging the taut line for movement between said storage and assembly locations and having a tool engagement sleeve for selectably connecting a tool to the transportation device and an elevation mechanism for selectively raising and lowering a logging tool;

a logging cable having one end positionable at the tool assembly location for travel into the wellbore at the wellsite and the other end wrapped and stored on a logging cable winch; and a winch remote control for selective rotation of the logging cable winch for controlling the movement of said logging cable.

20. The system of claim 19, including a tension means coupled to the taut line for applying tension to the taut line.

21. The system of claim 19, said logging tool including a threaded coupling at a distal end thereof, said threaded coupling including an engagement ring, said spanner including a gear configured for engaging and rotating said engagement ring.

22. The system of claim 19, further comprising:

a winch controller means for selective rotation of the logging cable winch and concomitant take off and take up of logging cable on the logging cable winch for configuring and deconfiguring a logging setup at a well site;

a receiver means attached to the winch controller for controlling the operation of the logging winch; and a remote control transmitter means which selectably transmits control signals to the receiver for controlling the operation of the logging cable winch.

23. The system of claim 22, the remote control transmitter means being transportable by an operator between the winch controller and a wellsite.

24. The system of claim 22 wherein the control signals are radio control signals.

25. A system for conveying wireline logging tools at a wellsite comprising:

a taut line extending between a tool storage location and a tool assembly location near a wellbore at the wellsite;

a tool trolley engaging the taut line for movement between said storage and assembly locations and having a tool engagement sleeve for selectably connecting a tool to the trolley and an elevation means for selectively raising and lowering a logging tool;

a logging cable having one end positionable at the tool assembly location for travel into the wellbore at the wellsite and the other end wrapped and stored on a logging cable winch; and a winch remote control for selective rotation of the logging cable winch for controlling the movement of said logging cable.

26. The system of claim 25, the tool trolley further comprising:

a body configured to slidably engage the taut line extending between the tool storage location and the wellsite; the tool engagement sleeve being attached to the body and configured to couple a logging tool to the body.

27. The system of claim 26, wherein said body includes a pulley for rotationally engaging the taut line.

28. The system of claim 26, wherein said sleeve comprises a link chain configured to be wrapped around the logging tool, both ends of the claim being connectable to said body.

29. The system of claim 25, said elevation means comprising an elongated pivotal toggle with one end coupled to said sleeve, where upon movement of said toggle said sleeve and logging tool are raised or lowered.

* * * * *